United States Patent [19]

Giaimo et al.

[11] Patent Number: 4,545,311

[45] Date of Patent: Oct. 8, 1985

[54] THREAD TENSIONING DEVICE FOR A SEWING MACHINE

[75] Inventors: Anthony Giaimo, Staten Island, N.Y.; Robert H. Larsen, Middletown; Donald Rodda, Butler, both of N.J.

[73] Assignee: The Singer Company, Stamford, Conn.

[21] Appl. No.: 637,193

[22] Filed: Aug. 2, 1984

[51] Int. Cl.[4] ..... D05B 47/02

[52] U.S. Cl. ..... 112/254

[58] Field of Search ..... 112/59, 97, 254; 242/150 R

[56] References Cited

U.S. PATENT DOCUMENTS

| | | | |
|---|---|---|---|
| 1,820,119 | 8/1931 | Chason | 112/254 |
| 2,937,605 | 5/1960 | Dunn et al. . | |
| 2,955,775 | 10/1960 | Johnson . | |
| 2,965,058 | 12/1960 | Herbst et al. . | |
| 2,986,358 | 5/1961 | Johnson . | |
| 3,150,846 | 9/1964 | Laidig | 112/254 X |
| 3,667,414 | 6/1972 | Illes et al. | 112/254 |

FOREIGN PATENT DOCUMENTS

| | | | |
|---|---|---|---|
| 723852 | 7/1942 | Fed. Rep. of Germany | 112/254 |
| ST 8146 | 10/1956 | Fed. Rep. of Germany | 112/254 |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A thread tensioning device, wherein a helical spring of varying diameter is deflected by a control knob with a defined operating range to increase tension in sewing thread moved through the device, is provided with a member which is formed to engage one or more intermediate coils of the spring while the spring is deflected more than a predetermined amount by the control knob and thereby increase thread tension obtainable over a portion of the operating range of the knob.

1 Claim, 3 Drawing Figures

THREAD TENSIONING DEVICE FOR A SEWING MACHINE

BACKGROUND OF THE INVENTION

1. Field of the Invention

The invention relates to tensioning devices for use on sewing machines.

2. Description of the Prior Art

It is necessary for the proper formation of stitches on a sewing machine, that an operator be able to adjust the tension of the sewing thread. The required tension varies according to the type of sewing which is to be performed as well as the weight of thread to be used, and must be variable over a wide range. However, the thread tensioning devices commonly provided on sewing machines are incapable of setting thread tensions at the upper end of the required range because of necessary physical limitations imposed on the operation of input controls on such devices.

It is a prime object of the present invention to increase the tension selecting capability of thread tensioning devices for sewing machines.

It is another object of the invention to increase the tension selecting range of a sewing machine thread tensioning device on which the rotation of the input control is limited to not more than one complete revolution.

It is also an object of the invention to increase the upper limit of the tension selecting capability of a thread tensioning device for a sewing machine without affecting the sensitivity of the device in a low tension selecting range.

Other objects and advantages of the invention will become apparent during a reading of the specification taken in conjunction with the accompanying drawings.

SUMMARY OF THE INVENTION

A thread tensioning device according to the invention includes an arbor, a pair of thread tensioning discs slidably mounted on the arbor, an arbor affixed stop on one side of the discs and a slidably mounted member on the arbor located on the opposite side of the discs. A helically coiled spring encircles the arbor and acts at one end against the said member to cause the discs to be squeezed against any thread extending therebetween, and so resist movement of the thread through the thread tensioning device. The device further includes an operator's control movable through a defined range for adjusting deflection and thereby the compression of coils of the spring to alter the resistance to movement of the thread through the device. The said member is formed to engage one or more intermediate coils of the spring while the spring is deflected more than a predetermined amount by the control, and by so impeding free flexure of the spring, increase the applied force obtainable at the discs over a portion of the operating range of the control.

DESCRIPTION OF THE PREFERRED EMBODIMENT

Figure 1:
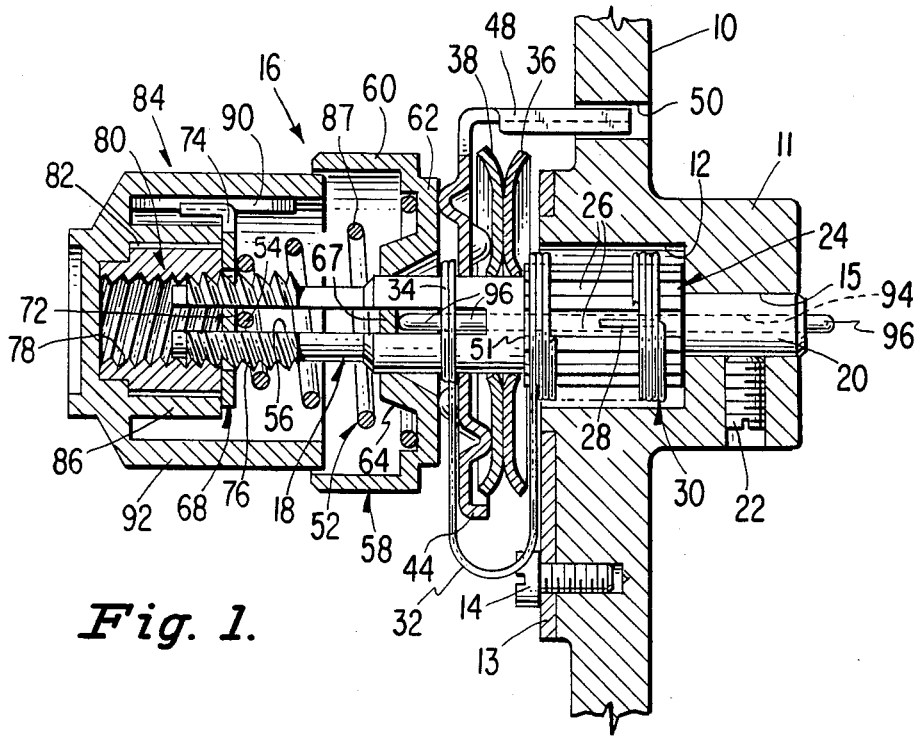
FIG. 1 is a sectional view of a thread tensioning device in accordance with the invention mounted on a sewing machine and adjusted for the application of light tension to sewing thread.

Referring to the drawings, reference character 10 designates a portion of the wall of a sewing machine having a boss 11 on the inside thereof for accommodating a bore or recess 12 extending inwardly from the front face to which a plate 13 is secured by a screw 14. A reduced diameter bore 15 is provided at the bottom of recess 12, as shown. The tension device 16 of the invention includes an arbor 18 having an end portion 20 affixed in bore 15 with a set screw 22 and an enlarged diameter portion 24 in recess 12. The enlarged diameter portion 24 of arbor 18 is provided with a plurality of longitudinally extending grooves 26, in a selected one of which is seated and therby anchored the one end 28 of a check spring 30 coiled about the arbor and having at the other end a laterally extending thread engaging U-shaped portion 32 terminating in a loop 34 that is coiled about the arbor.

Tension device 16 includes thread engaging means in the form of two tension discs 36 and 38 having central apertures 40 and 42 at which the discs are slidably mounted on arbor 18. The discs are dish shaped and are disposed on arbor 18 with convex thread engaging sides in an opposing relationship. A guard plate 44 is slidably mounted at aperture 46 on the arbor outwardly of the tension discs, and has an arm 48 thereon seated in an opening 50 in wall 10. The innermost tension disc 36 abuts against a stop defined by the shoulder 51 at the outer end of enlarged portion 24 of the arbor, and the discs 36 and 38 are resiliently urged against it by a bee hive spring 52 coiled about the arbor and having the outer end thereof formed with a finger 54 that is seated in a slot 56 extending longitudinally inwardly from the free end of arbor 18. Disposed between the base or inner end of spring 52 and guard plate 44 is an inner spring cover 58 having a cylindrical side wall 60, and a base 62 including a raised conically tapered central portion 64 with an aperture 66 for receiving arbor 18. Aperture 66 is transversed by a diameter bar 67 that is seated in slot 56 to hold the cover against turning on the arbor.

The outer end of spring 52 abuts against an anchor disc 68 having a central aperture 70 and a diameter bar 72 that traverses the aperture. Arbor 18 extends through aperture 70 with the bar 72 received in slot 56 to hold the disc end against turning. Anchor disc 68 includes a radially extending finger 74.

The free end of arbor 18 is formed with external threads 76 which are engaged by the internal threads 78 of an adjusting nut 80. The threads 76 and cooperating threads 78 on the adjusting nut have a lead in one revolution equal to the desired axial displacement of the adjusting nut. Adjusting nut 80 includes an enlarged knurled cylindrical surface 82 upon which a control knob 84 is affixed. Knob 84 includes a central cylindrical section 86 which is force fitted over cylindrical surface 82 of the adjusting nut and has ridges 88 formed thereon to engage surface 82 and prevent relative rotation of the nut and knob. The knob includes an internal lug 90 engageable with finger 74 on anchor disc 68 for limiting turning of the knob and thereby nut 80 to one revolution. Knob 84 includes a spring protective skirt 92 which telescopes within side wall 60 of spring cover 58. Arbor 18 is formed with a bore 94 in which there is received the usual tension releasing plunger 96 that engages against the bar 67 on the inner spring cover 58 to force it away from the tension discs against the action of spring 52.

In operation, the spring 52 acting at the outer end through disc 68 on the adjusting nut 80, and acting at its inner end through the inner spring cover 58 and guard plate 44 biases the tension discs 36 and 38 against shoulder stop 51 located on the opposite side of the discs from the spring. As the adjusting nut 80 is turned with knob 84, the nut is displaced axially along arbor 18, and the compression of spring 52 with the bias imposed thereby on the tension discs is varied accordingly. Indicia such as numerals 98 on knob 84, and a mark 100 on cover 58 serve to indicate the setting of tension within the range of adjusting nut 80 as limited by finger 74 on anchor disc 68 and internal lug 90 on knob 84.

After all elements up to and including the anchor disc 68 have been mounted on arbor 18 during the assembly of tension device 16, adjusting nut 80 is threaded onto the arbor to a position corresponding to a desired minimum tension. Knob 84 is then affixed to nut 80 in a position wherein lug 90 engages finger 74 and from which the knob may be turned through a tension selecting range of one complete revolution to deflect spring 52 and thereby increase tension to a maximum as limited by reengagement of lug 90 with finger 74.

Figure 2:
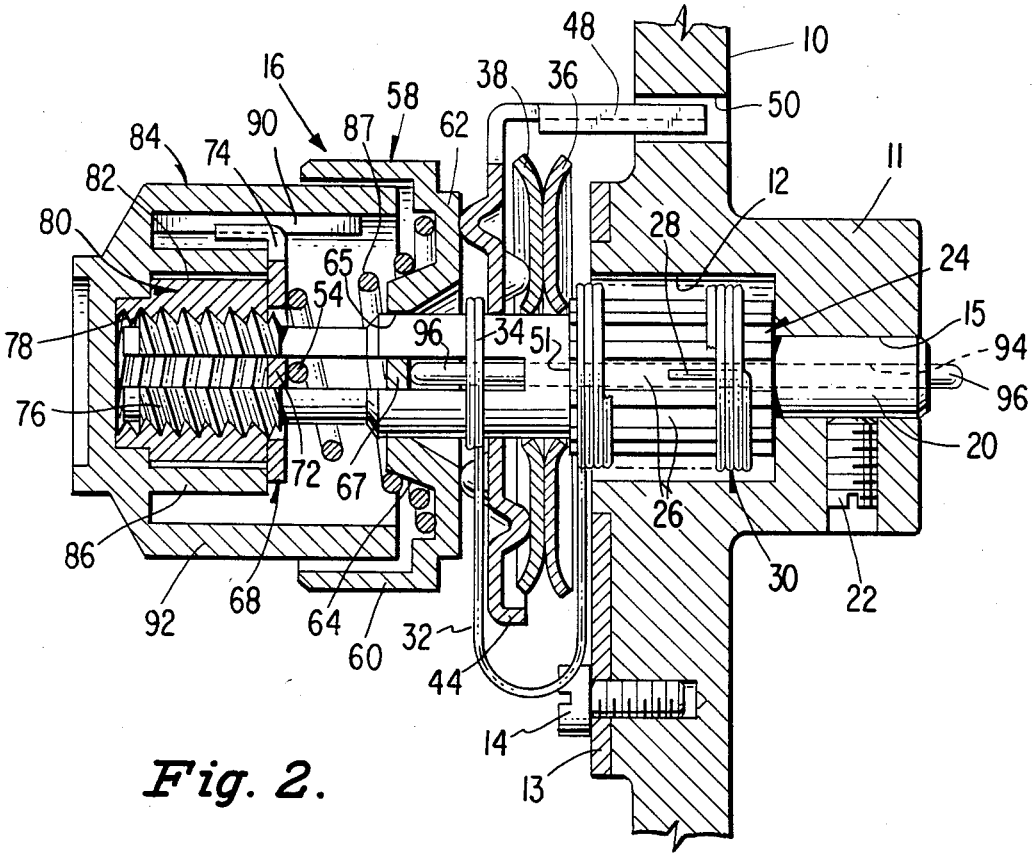
FIG. 2 is a view similar to FIG. 1 showing the thread tensioning device adjusted for the application of high tension.
Figure 3:
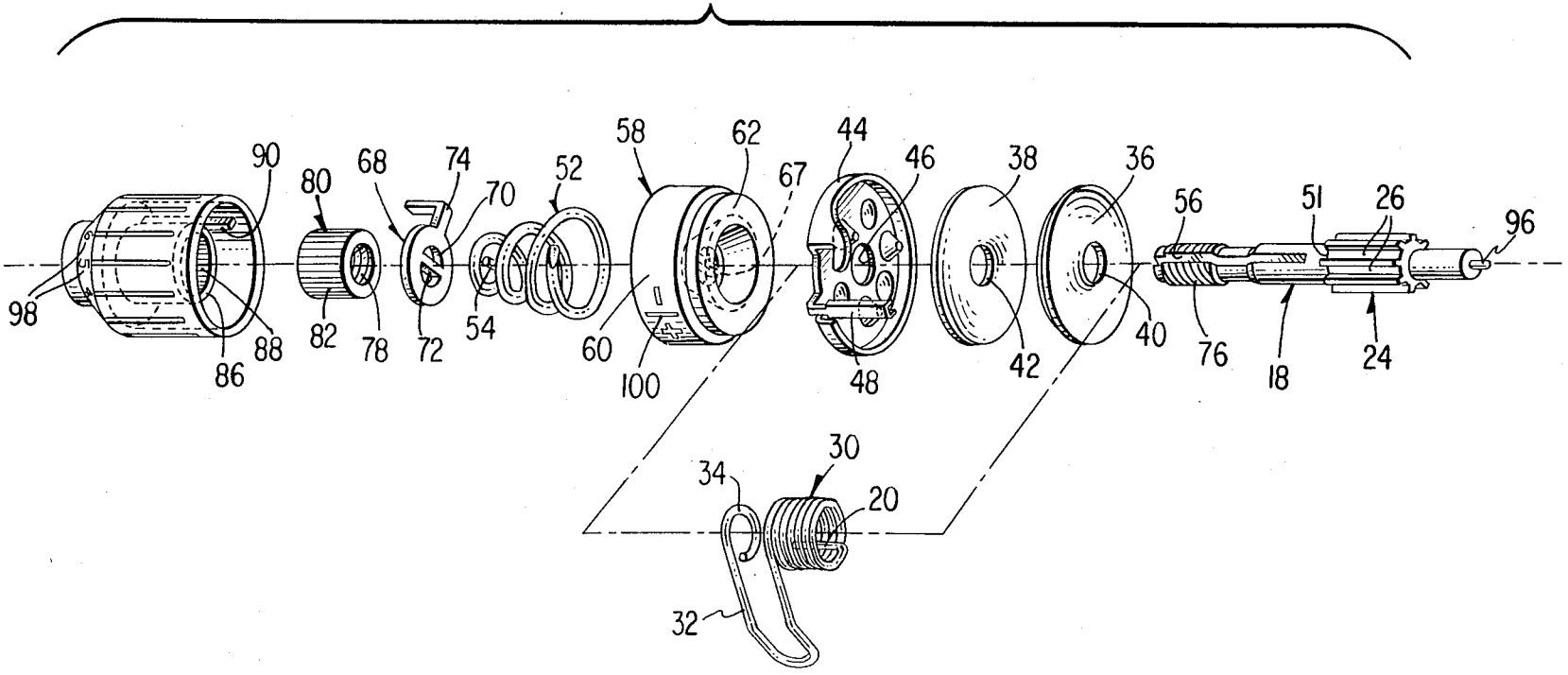
FIG. 3 is an exploded perspective view of the thread tensioning device of FIGS. 1 and 2.

The tapers and relative dimensions of spring 52 and raised central portion 64 of base 62 are selected to prevent engagement of the spring with raised central portion 64 of base 62 while knob 84 is within a low end portion of its tension selecting range (FIG. 1), but provide for the engagement of one or more spring coils with base portion 64 while the knob is in the upper end portion of the tension selecting range (FIG. 2). Initial engagement occurs between spring 52 and base portion 64 at an intermediate spring coil 96 when the spring has been deflected a predetermined amount of the movement of knob 84, and as the spring is increasingly deflected by continued movement of the knob toward the maximum tension selecting position an increasing portion of the intermediate coils of the spring frictionally engages base portion 64 to increasingly impede deflection of the spring. The movement required of knob 84 to achieve a given increase in thread tension therefore decreases with the continued movement of the knob toward the maximum tension selecting portion. While tension device 16 is rendered capable of applying greater thread tension than would be the case without engagement of the spring with base portion 64, the sensitivity of the device is unaffected in the low tension selecting range, that is while the spring is out of contact with base portion 64, and an operator can then apply light tension with refinement.

It is to be understood that the present disclosure relates to a preferred embodiment of the invention which is for purposes of illustration only and is not to be construed as a limitation of the invention. Numerous aleteations and modifications of the structure herein disclosed will suggest themselves to those skilled in the art, and all such modifications and alterations which to not depart from the spirit and scope of the invention are intended to be included within the scope of the appended claims.

We claim:

1. A thread tensioning device for a sewing machine including an arbor, a pair of thread tensioning discs slidably mounted on the arbor, an arbor affixed stop on one side of the discs, a slidably mounted member on the arbor located on the opposite side of the discs from the stop, a raised conically tapered portion formed on said member, a helically coiled spring which encircles the raised portion of said member and acts at one end against said member to cause the discs to be squeezed against any thread extending therebetween and so resist movement of the thread through the thread tensioning device, and an operator's control movable through a defined range for adjusting deflection and thereby the compression of coils of the spring to alter the resistance to movement of the thread through said device, the improvement which comprises so dimensioning said raised conically tapered portion of said member relatively to the internal dimensions of said helically coiled spring as to cause engagement of one or more intermediate coils of the spring with said raised portion of said member after the spring is partially deflected by the control, and by so impeding free flexure of the spring, increase the applied force obtainable at the discs by each increment of movement of said control over a portion of the operating range of said control.

* * * * *